United States Patent [19]

Gilcrease

[11] Patent Number: 5,067,569

[45] Date of Patent: Nov. 26, 1991

[54] AUGER AND SWEEPER ASSEMBLY

[76] Inventor: John T. Gilcrease, 7000 W. Gilcrease Ave., Las Vegas, Nev. 89131

[21] Appl. No.: 576,592

[22] Filed: Aug. 31, 1990

[51] Int. Cl.[5] ..... E21B 7/00; E21B 21/00

[52] U.S. Cl. ..... 175/209; 175/88; 175/121; 175/161; 175/315

[58] Field of Search ..... 175/84, 88, 121, 161, 175/207, 209, 211, 310, 315, 316, 323

[56] References Cited

U.S. PATENT DOCUMENTS

| | | | |
|---|---|---|---|
| 521,175 | 6/1894 | Odewahn et al. . | |
| 1,036,230 | 8/1912 | Harris . | |
| 1,107,927 | 8/1914 | Fuchs . | |
| 2,061,218 | 11/1936 | Watson | 255/19 |
| 2,121,680 | 6/1943 | Houston | 255/19 |
| 2,783,974 | 3/1957 | Veasman | 255/74 |
| 2,887,300 | 5/1959 | Meredith | 255/73 |
| 3,056,093 | 12/1974 | Case | 175/88 |
| 3,190,375 | 6/1965 | Pearson | 175/209 |
| 3,835,941 | 9/1974 | King | 175/315 |
| 4,364,441 | 12/1982 | Geeting | 175/84 |

*Primary Examiner*—Bruce M. Kisliuk

*Attorney, Agent, or Firm*—Quirk, Tratos & Roethel

[57] ABSTRACT

An auger assembly for drilling holes or similar openings in the ground includes an auger blade mounted for vertical movement and a dirt retaining shell that surrounds the auger blade also mounted for vertical movement independently of the auger blade. When the hole has been drilled to the appropriate depth, the retaining shell is lowered down into the hole to surround the auger blade and the auger blade and the retaining shell are removed from the hole simultaneously. The retaining shell retains the dirt on the auger blade to prevent the dirt from falling back into the hole. A pair of lateral extensions provide a cutting a cutting edge on the perimeter of the auger blade in order to provide a hole which is slightly larger in diameter than the diameter of the auger blade to permit the retaining shell to be lowered around the auger blade. Another element of the assembly is a pair of sweeper arms mounted coaxially with the auger blade but independent from the auger blade and oriented adjacent the surface of the ground to disperse dirt being removed from the ground to prevent the dirt from falling back into the hole. The entire auger assembly is mounted on a tractor or other vehicle for transporting the auger assembly through the field. Hydraulic equipment is used to power and actuate the auger assembly.

5 Claims, 7 Drawing Sheets

AUGER AND SWEEPER ASSEMBLY

BACKGROUND OF THE INVENTION

This invention relates to an auger and sweeper assembly, and more particularly to an auger and sweeper assembly that utilizes a sweeper member mounted independently from the auger blade to clean dirt away from the hole.

For many years, augers have been used to dig holes in the ground. Whether the hole will be used as a well to obtain subterranean water or simply a mounting location in which a post or pole is received, the auger must perform the function of removing the dirt from the ground so that a useable hole remains.

Most augers have helical or screw-like blades that spiral rotationally into the ground and cut into the dirt. The helical surface of the blades feeds the dirt upward toward the surface. The dirt being removed from the ground to form the hole naturally piles up adjacent the hole. Unless this loose dirt is moved, there will be a tendency for the dirt in the pile to fall back into the hole when the auger blade is removed.

Also when the auger blade is removed from the hole, any dirt physically on the blade may fall back into the hole. Any dirt that falls back into the hole after it had been previously removed from the hole simply decreases the efficiency of the auger, normally requires manual removal and significantly extends the time necessary to dig the hole.

It is an object of the present invention to provide an improved auger assembly that efficiently removes dirt from the hole being dug and generally eliminates any significant fall back of dirt into the freshly dug hole.

It is a feature of the present invention to utilize a sweeper arm attached to the auger assembly, but independent from the auger blade, to laterally relocate the dirt being excavated from the ground away from the hole to minimize the possibility of the loose dirt falling back into the hole.

It is an advantage of the present invention that the efficiency of an auger assembly will be improved and the hole dug in the ground will be generally clean and free from loose dirt to eliminate the necessity of manually finishing the excavation of the hole before it can be used for its intended purpose.

SUMMARY OF THE INVENTION

An auger assembly for drilling post holes or similar openings in the ground includes an auger blade mounted for vertical movement and a dirt retaining shell that surrounds the auger blade also mounted for vertical movement in relation to the auger blade. When the hole has been drilled to the useable depth of the auger, the retaining shell is lowered down into the hole to surround the auger blade and the auger blade and the shell are removed from the hole simultaneously. The retaining shell retains the dirt on the auger blade to prevent the dirt from falling back into the hole. The drilling and removal of dirt is repeated until the hole reaches the appropriate depth. Another element of the assembly is a pair of lateral extensions which provide a cutting edge on the perimeter of the auger blade in order to provide a hole which is slightly larger in diameter than the diameter of the auger blade to permit the retaining shell to be lowered around the auger blade. Another element of the assembly is a pair of sweeper blades mounted coaxially with the auger blade but independent of the auger blade and oriented adjacent the surface of the ground to disperse dirt being removed from the ground to prevent the dirt from falling back into the hole. The entire auger assembly is mounted on a tractor or other vehicle for transporting the auger assembly through the field or another area where holes are desired. Hydraulic equipment, or other suitable means such as electric or pneumatic equipment, is used to power and actuate the auger assembly.

DETAILED DESCRIPTION OF THE PREFERRED EMBODIMENTS

Figure 1:
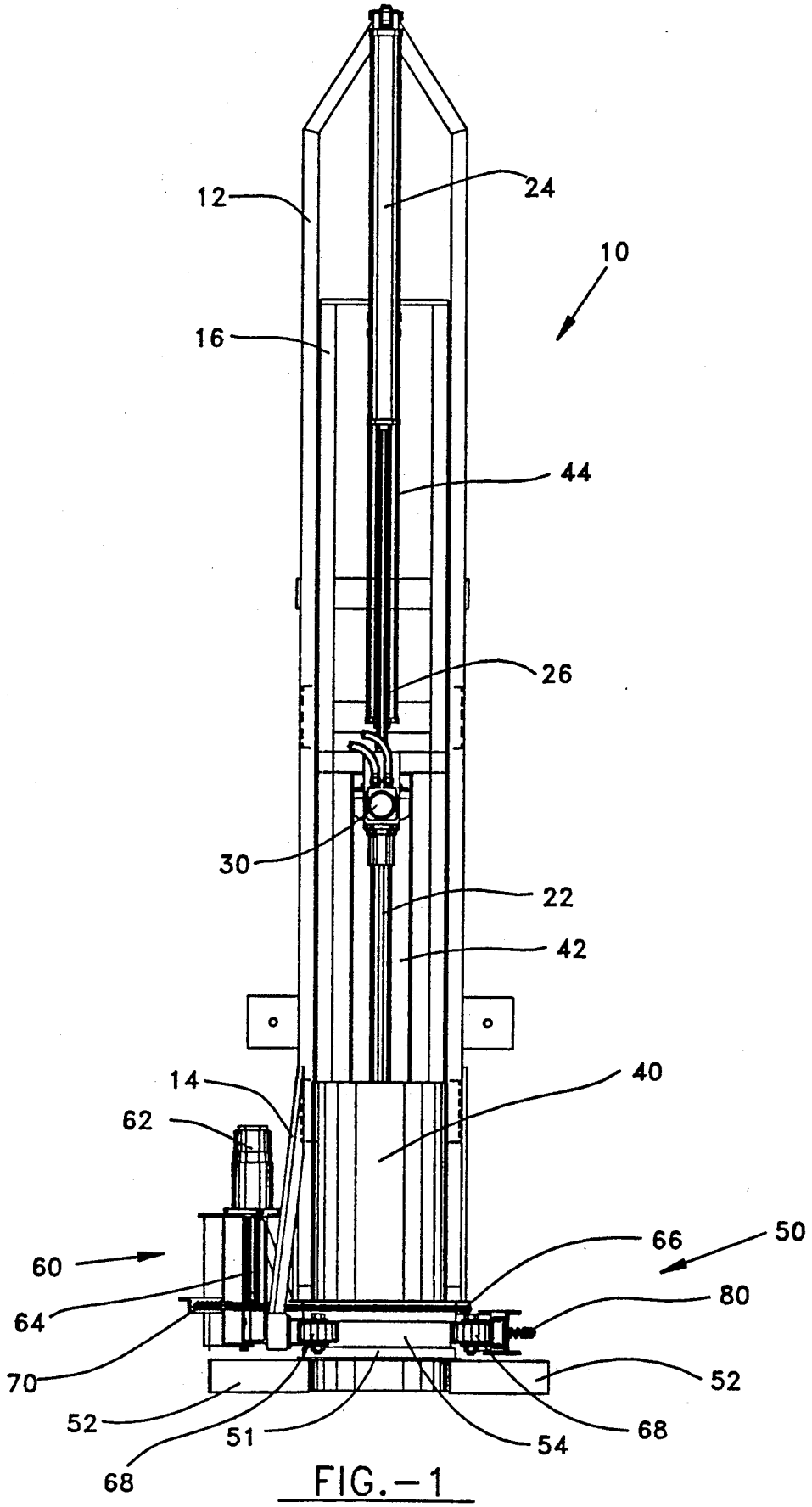
FIG. 1 shows a front view of the auger assembly of the present invention.

The auger assembly of the present invention is shown generally at 10 in FIG. 1. The auger assembly 10 has an upright vertical auger support frame 12 generally comprising two parallel beams. At the lower end of the auger support frame 12, each beam has a lower frame extension 14 which connects the sweeper arm assembly 60 to the auger support frame 12.

At the upper end of the auger support frame 12, a auger hydraulic ram 24 is connected by any conventional connecting means such as the bolt arrangement illustrated. The auger hydraulic ram 24 has a piston 26 which extends downwardly and connects to the auger shaft 22. An auger blade 20 extends from the end of the auger shaft 22. The auger blade 20 has an auger feed screw 21 to start the boring of the dirt to make a hole. The auger hydraulic ram 24 is used to raise and lower the auger blade 20. An auger rotary motor 30 is connected to the auger shaft 22 to provide the necessary rotary movement to the auger blade 20 needed to drill the hole in the ground.

Oriented generally behind and parallel to the auger support frame 12 is a retaining shell support frame 16. The retaining shell support frame 16 also generally comprises two parallel beams. At the top of the retaining shell support frame 16, a retaining shell hydraulic ram 44 is connected by any conventional connecting means such as the bolt arrangement illustrated. The retaining shell hydraulic ram 44 includes a piston 46 which connects to the upper end of the retaining shell extension 42 on the retaining shell 40. The retaining shell hydraulic ram 44 is used to raise and lower the retaining shell 40.

The retaining shell 40 is a generally cylindrical body made of cast iron or other appropriate material. The retaining shell 40 has a diameter slightly larger than the diameter of the auger blade 20 so that the retaining shell 40 can be lowered into a surrounding relationship to the auger blade 20. At the top of the retaining shell 40, there is a retaining shell extension 42 which is a generally arcuately shaped member that extends upwardly from the retaining shell 40 and provides a mounting surface to which the piston 46 can be attached.

Figure 3:
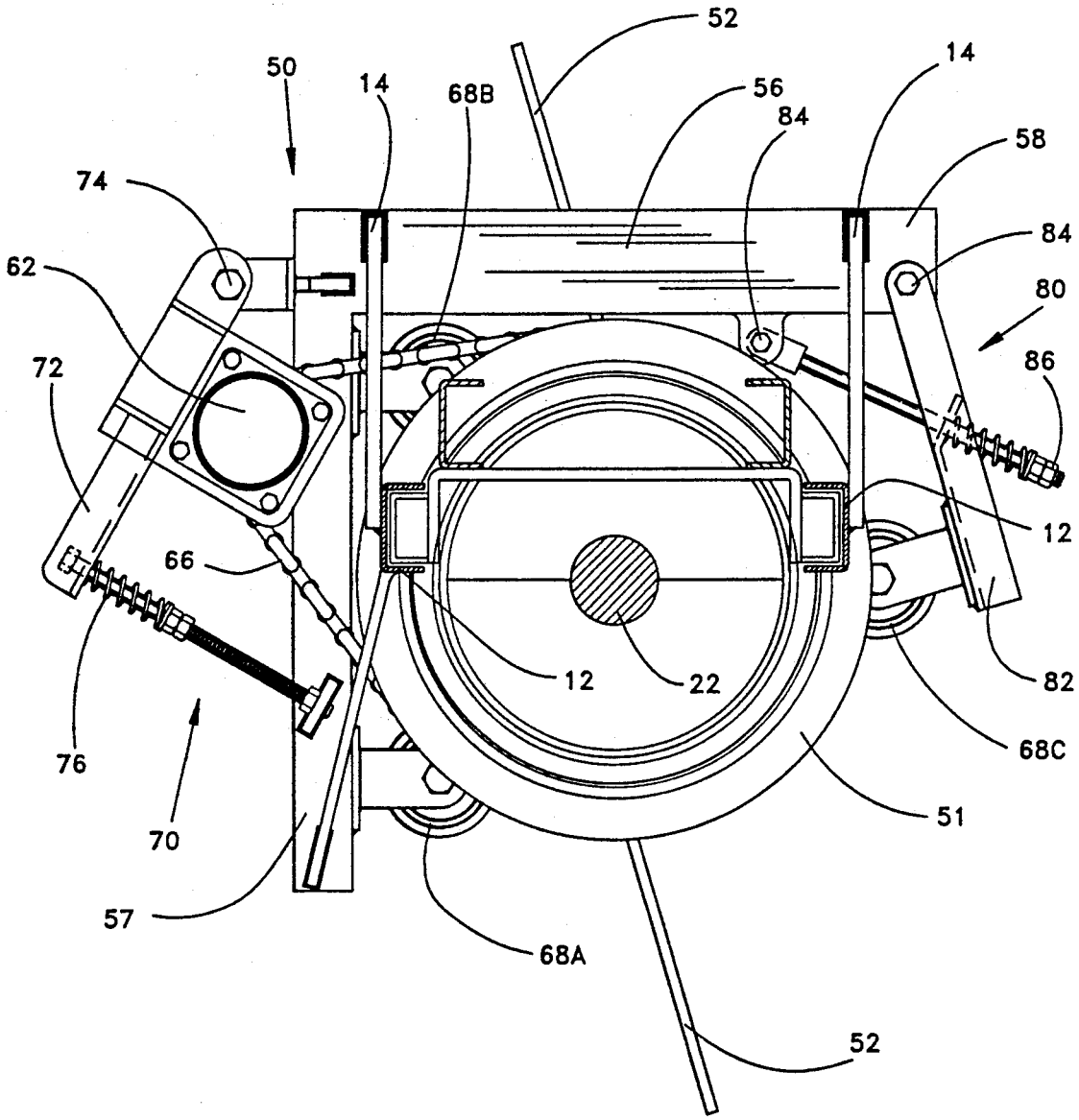
FIG. 3 shows a top view of the auger assembly of the present invention.

As shown in FIGS. 1 and 3, a sweeper assembly 50 is mounted at the lower end of the auger assembly 10. The sweeper assembly 50 comprises a guide drum 51 mounted by means of the lower frame extension 14 at the lower end of the auger support frame 12. The guide drum 51 has a plurality of sweeper arms 52, preferably two in number, radially disposed from the guide drum 51 for sweeping the dirt extracted from the ground away from the hole. The guide drum 51 also has a central guide track 54 in which a plurality of guide wheels 68 are disposed. The guide drum 51 also has a plurality of teeth disposed around the circumference of the guide drum 51 which cooperate with a sweeper drive chain 66 which functions to cause the guide drum 51 to rotate. The sweeper drive chain 66 is driven by a sweeper drive motor 62 mounted on the sweeper assembly 50. Extending from the sweeper drive motor 62 is a sweeper drive shaft 64 which turns a tooth gear to drive the sweeper drive chain 66.

Alternatively, the guide drum 51 can be driven by a pinion gear or a ring gear, instead of the drive chain mechanism shown in the drawings.

An L-shaped frame 56 is disposed around the guide drum 51 and the guide wheels 68A and 68B are mounted on a first leg 57 of the L-shaped frame 56. The mounting of the guide wheels 68A and 68B allow each guide wheel to rotate when the guide drum 51 is caused to rotate. A third guide wheel 68C is also mounted for rotation on a guide wheel tensioning assembly 80. The guide wheel tensioning assembly 80 comprises an arm 82 pivotally connected to the second leg 58 of the L-shaped frame 56 by a bolt 84. The tension of the third guide 68C on the guide track 54 can be adjusted by means of the turnbuckle 86 which is connected at its one end to the second leg 58 of the L-shaped frame 56 by a bolt 84 and at its other end to the arm 82.

Likewise the tension of the sweeper drive chain 66 can be adjusted by means of the chain tensioning assembly 70. The chain tensioning assembly 70 comprises an arm 72 pivotally connected to the first leg 57 of the L-shaped frame 56 by means of a bolt 74. The sweeper drive motor 62 is mounted on the arm 72. A turnbuckle 76 is used to tension the sweeper drive chain 66 with one end of the turnbuckle 76 connected to the first leg 57 of the L-shaped frame 56 and the its other end attached to the arm 72.

The auger assembly 10 is connected to a tractor (not shown) by means of a tractor frame 90 Which includes a tractor arm 91 extending from the tractor to the auger assembly 10. The tractor frame 90 also includes a lateral arm 92 that joins the tractor arm 91 in pivotable attachment to the auger support frame 12 of the auger assembly 10. Extending downward from the lateral arm 92 is a telescoping member 94 which has a foot member 98 on its lower end. The foot member 98 assists in supporting the auger assembly 10 on the ground when the auger assembly 10 is lowered from the tractor into operable relationship with the ground. The lower end of the telescoping member 94 is joined by means of a connecting arm 97 with the L-shaped frame 56. A piston 96 controls the length of the telescoping member 94 so that the foot member 98 can be placed on the ground when the auger assembly 10 is ready to be used.

The entire auger assembly 10 is carried on a tractor or other appropriate vehicle so that the auger assembly 10 can be transported to whatever location it is desired to dig post or other holes. The power for actuating the auger hydraulic ram 24, the auger rotary motor 30, the retaining shell hydraulic ram 44, the sweeper drive motor 62 and the piston 96 comes from the tractor that carries the auger assembly 10. In the preferred embodiment, hydraulic power is used since this type of power is the most convenient for use outside in the field. Alternatively, electric or pneumatic equipment can be used to power the assembly.

Figure 2:
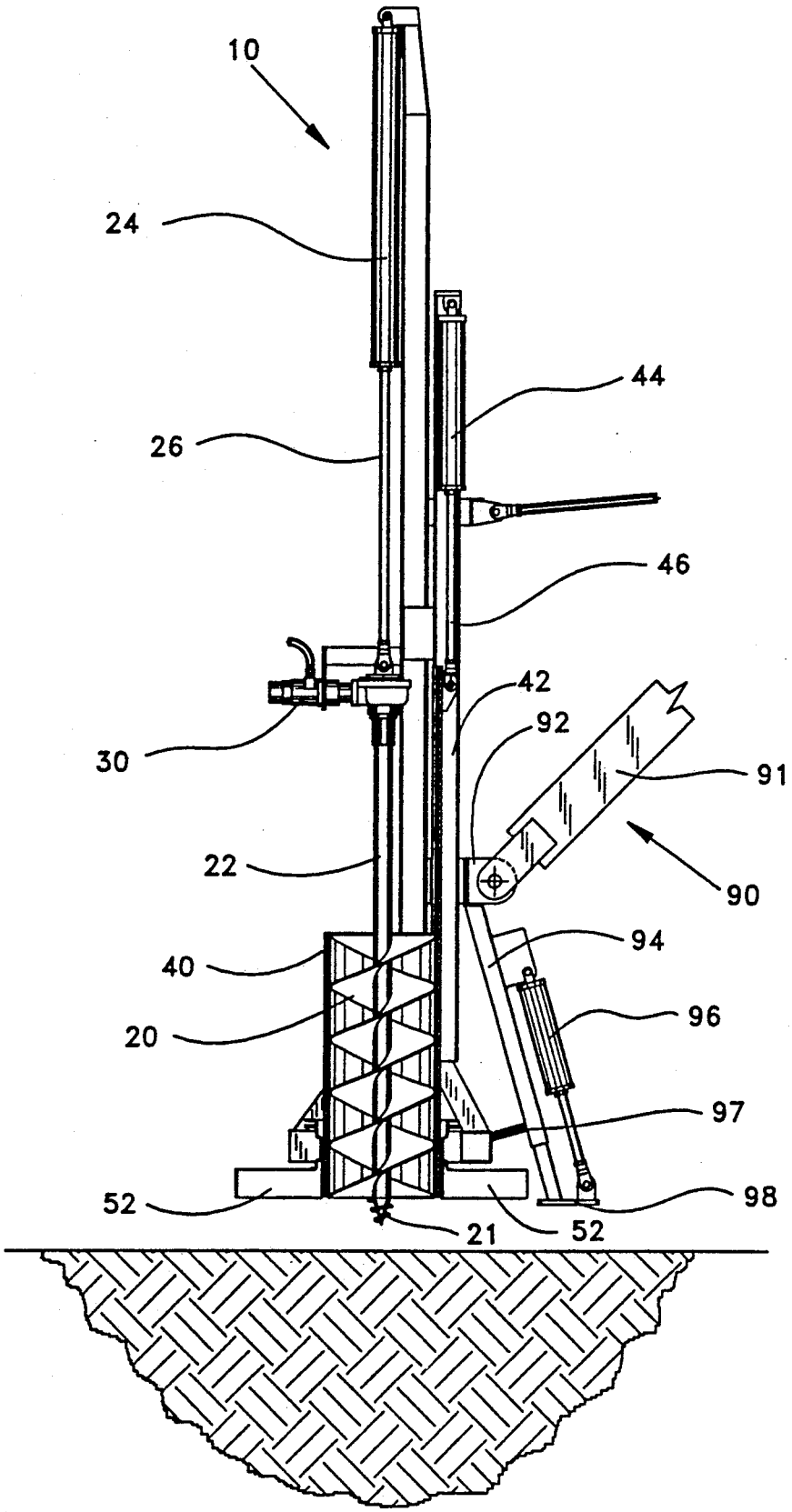
FIG. 2 shows a side view partially in cutaway of the auger assembly of the present invention.

The operation of the auger assembly 10 of the present invention will now be described. As shown in FIG. 2, the auger assembly 10 is positioned over the point on the ground where it is desired to dig a hole. The piston 96 is activated to cause the telescoping member 94 to extend downwardly until the foot member 98 comes into contact with the ground. The position of the tractor arm 91 is adjusted to locate the sweeper arm assembly 60 the desired height from the ground so that the sweeper arms 52 are positioned at ground level. The auger hydraulic ram 24 is activated to position the auger feed screw 21 at the surface of the ground to begin the removal of dirt to make a hole.

Figure 4:
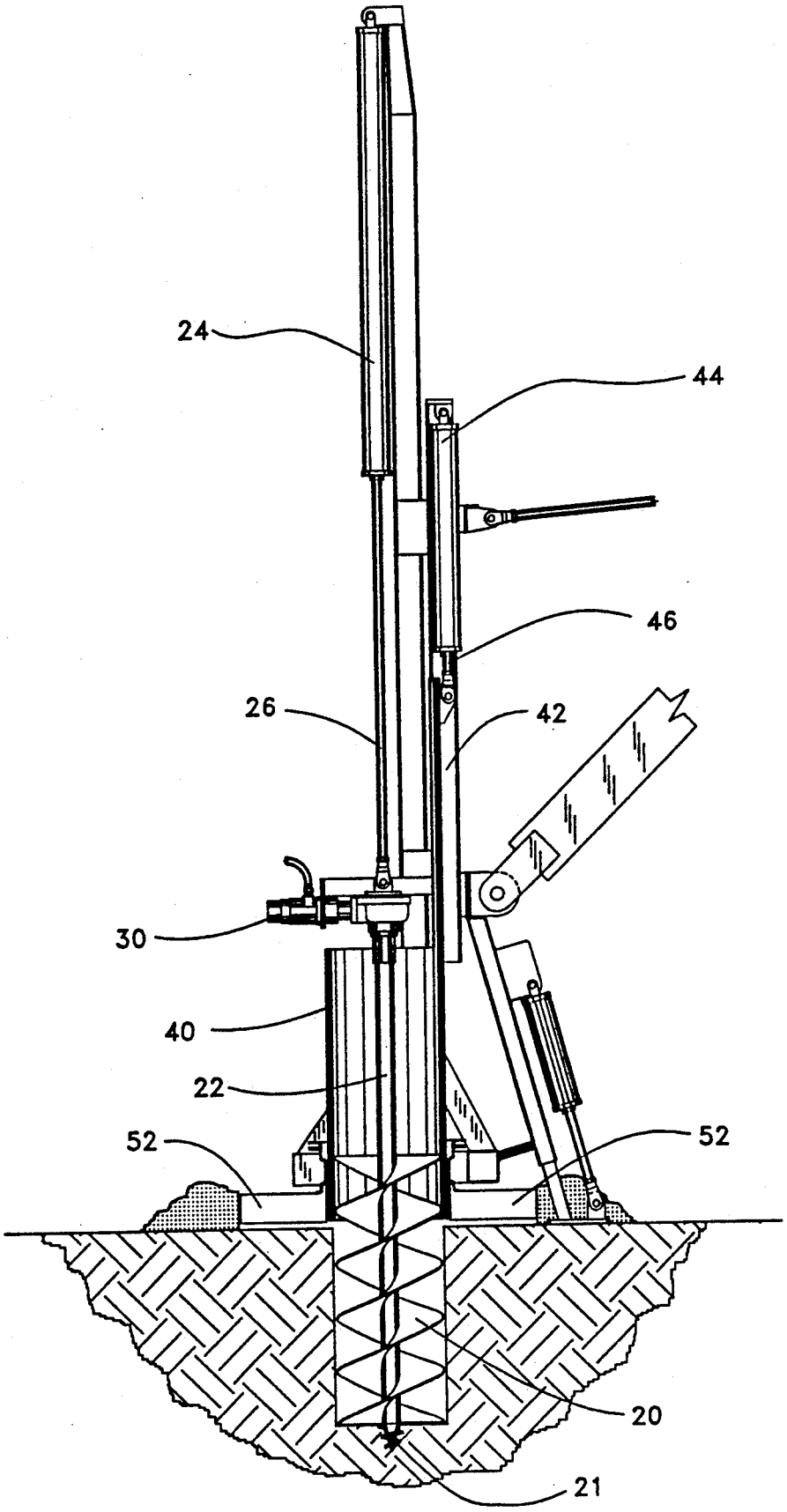
FIG. 4 shows a side view partially in section of the auger assembly of the present invention with the auger blade in the cutting position and the shell in the retracted position.

When the auger rotary motor 30 is activated, the auger shaft 22 will begin to rotate and the auger feed screw 21 followed by the auger shaft 22 will dig into the ground. The spiral of the auger blade 20 will feed the loose dirt back to the surface. As shown in FIG. 4, the retaining shell 40 is held above the surface of the ground to allow the loose dirt as it reaches the surface to fall off of the auger blade 20 to the side of the hole.

At the same time that the auger rotary motor 30 is causing the rotation of the auger shaft 22, the sweeper drive motor 62 has been activated to cause the guide drum 51 to rotate. The rotation of the guide drum 51 effects a rotation of the sweeper arm 52 which causes a sweeping away of the dirt from the hole. As shown in FIG. 3, the sweeper arms 52 are set at an angle relative to the axis of the auger shaft 22 to move the dirt away from the hole. As the auger blade 20 digs into the ground, the auger hydraulic ram 24 is also activated to extend the piston 26 downwardly to control the depth of the hole being made by the auger blade 20.

Figure 5:
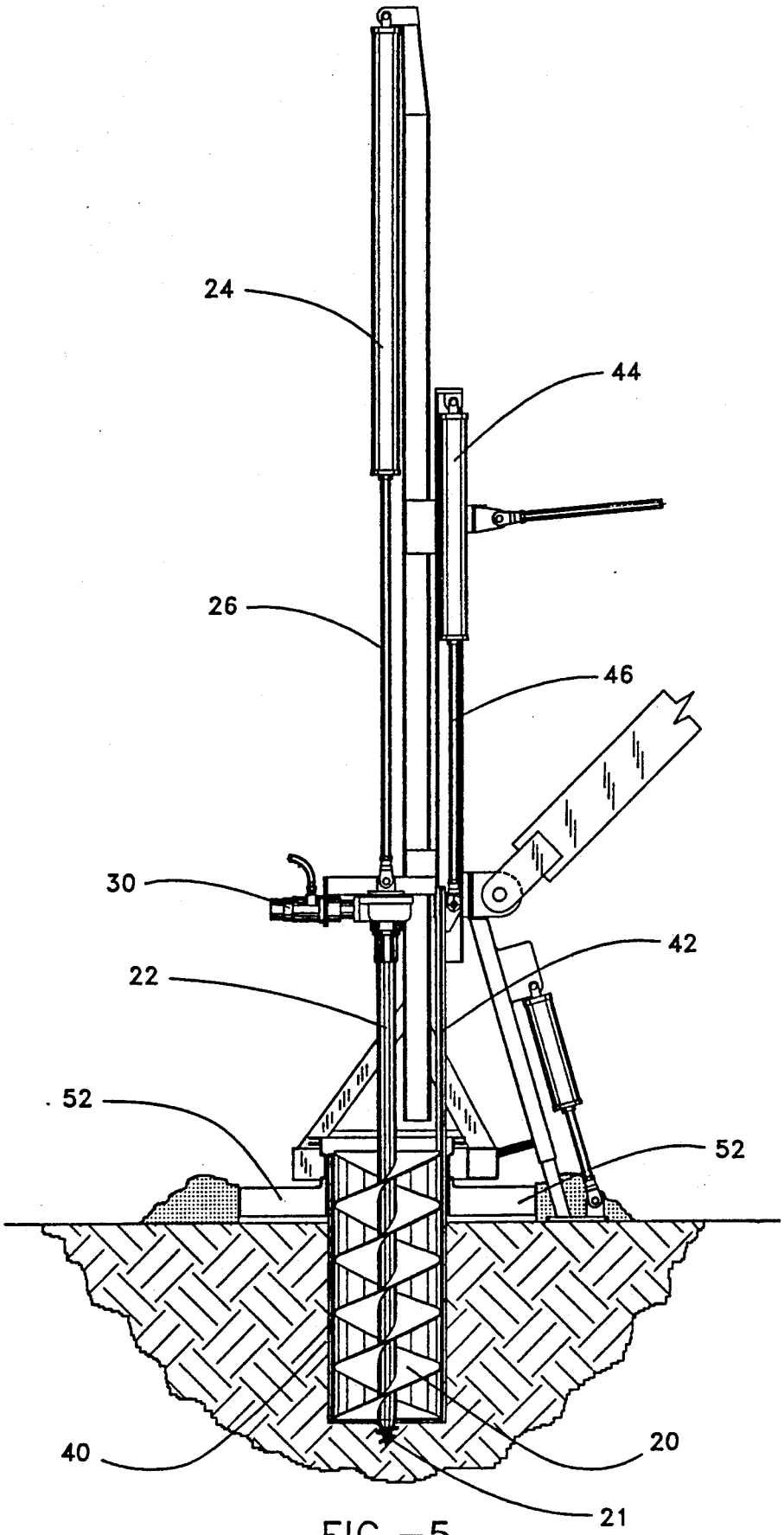
FIG. 5 shows a side view partially in section of the auger assembly of the present invention with the auger blade in the cutting position and the shell in the extended position surrounding the auger blade.

As shown in FIG. 5, when the auger blade 20 has descended to the desired depth, the retaining shell hydraulic ram 44 is activated to extend the piston 46 downwardly to cause the retaining shell 40 to be lowered into the hole around the auger blade 20 and for the full length of the auger blade 20. This positioning of the retaining shell 40 relative to the auger blade 20 effectively holds the loose dirt on the auger blade 20.

Figure 6:
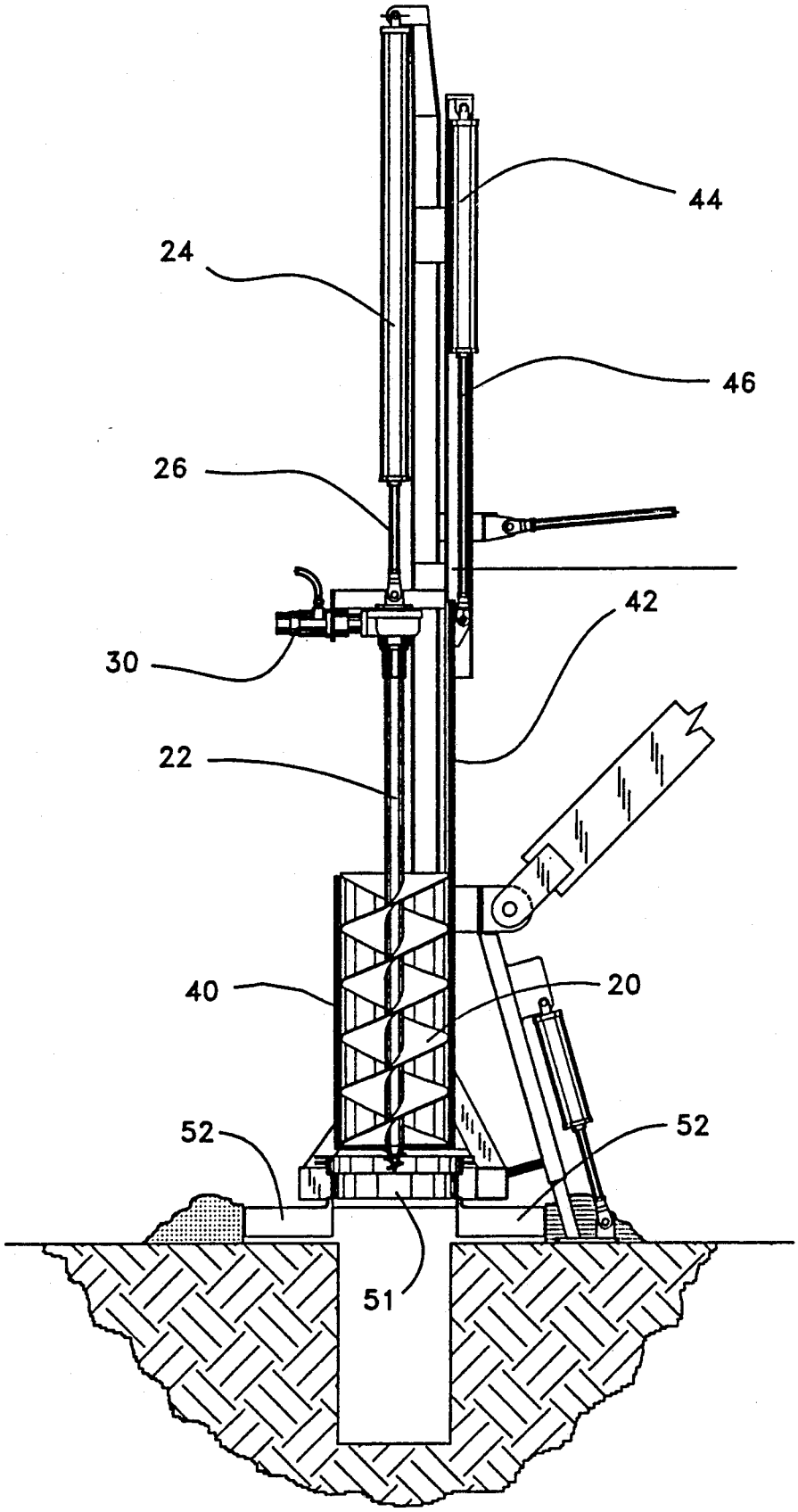
FIG. 6 shows a side view partially in section of the auger assembly of the present invention with both the auger blade and the shell in the retracted position.

As shown in FIG. 6, the auger blade 20 and the retaining shell 40 are both lifted out of the hole at the same time by the activation of the auger hydraulic ram 24. Again the retaining shell 40 holds the loose dirt on the auger blade 20 and prevents the loose dirt from falling back into the hole during the lifting of the auger blade 20 out of the hole.

The retaining shell support frame 16 on which the retaining shell 40 is mounted is attached to the auger support frame 12 on which the auger blade 20 is mounted. The retaining shell 40 automatically goes up or down with the auger blade 20 as the auger hydraulic ram 24 raises or lowers. The retaining shell hydraulic ram 44 only changes the position of the retaining shell 40 in relation to the auger blade 20. The combined movement of the retaining shell 40 when the auger blade 20 is moving makes it easier on the operator since it is extremely difficult for an operator to operate two cylinders or rams simultaneously at the same speed.

Figure 7:
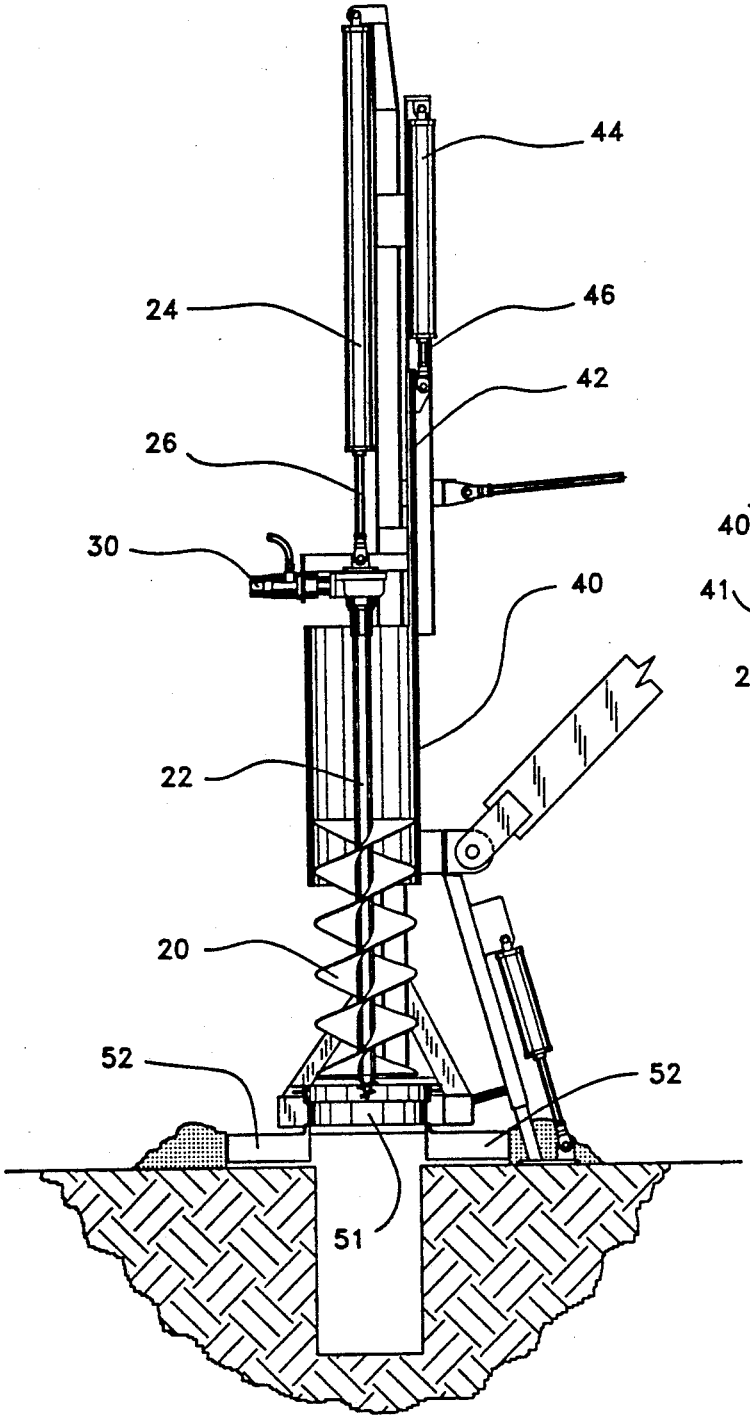
FIG. 7 shows a side view partially in section of the auger assembly of the present invention with the auger blade in the retracted position and the shell in the raised position allowing dirt to fall off of the auger blade.

As shown in FIG. 7, the retaining shell 40 is finally raised above the level of the auger blade 20 and, upon activation of the auger rotary motor 30, the auger blade 20 will again rotate which causes the dirt of the auger blade 20 to be flung to the sides of the hole where it is swept even farther away from the hole by the action of the sweeper arms 52.

Figure 8:
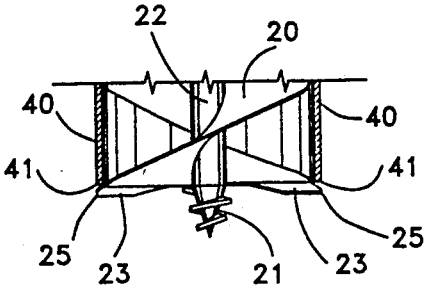
FIG. 8 shows the end of the auger assembly of the present invention showing the lateral extensions on the end of the auger blade.

FIG. 8 shows the lateral extensions 23 attached to the end of the auger blade 20. In the preferred embodiment, there will be two lateral extensions 23, one at each diametrically opposed location on the perimeter of the auger blade 20. The lateral extension 23 has a cutting edge member 25 that extends outwardly beyond the circumference of the auger blade 20. This cutting edge member 25 cuts through the dirt so that the resulting hole will have a diameter large enough to accommodate the shell member 40 when the shell member 40 is lowered into the ground around the auger blade 20.

Following the successful creation of a post or other type of hole, the auger assembly 10 can be moved by the tractor to a new location to dig another hole.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. An auger assembly comprising:

a) an auger support frame, b) an auger blade mounted for vertical movement on the auger support frame, c) a first motor operatively associated with the auger blade for rotating the auger blade to dig a hole, d) a sweeper drive assembly mounted on the auger support frame, the sweeper drive assembly including 1) a guide drum mounted for rotary movement and having at least one sweeper arm mounted thereon, 2) an L-shaped frame mounted around the guide drum, 3) at least one guide wheel mounted on the L-shaped frame for guiding the guide drum during rotation, and 4) a drive chain operatively associated with the drive guide for rotating the guide drum when the second motor is activated, e) at least one sweeper arm mounted on the sweeper drive assembly, and f) a second motor mounted on the sweeper drive assembly and connected to the sweeper arm for rotating the sweeper arm to clean dirt away from the hole, the sweeper arm being operable independent from the auger blade.

2. The auger assembly of claim 1 wherein the guide drum includes a central track in which the guide wheel rides.

3. The auger assembly of claim 1 wherein three guide wheels are mounted on the L-shaped frame to guide the guide drum and at least one of the guide wheels is adjustable to vary the tension of the guide wheels on the guide drum.

4. The auger assembly of claim 1 wherein the second motor is mounted on an arm pivotally mounted on the L-shaped frame so that the position of the second motor can be adjusted to vary the tension on the drive chain.

5. The auger assembly of claim 1 wherein at least two sweeper arms are mounted on the guide drum at an angle to the axis of the guide drum to sweep the dirt away from the hole.

* * * * *